US008616168B2

(12) United States Patent
Copper et al.

(10) Patent No.: US 8,616,168 B2
(45) Date of Patent: Dec. 31, 2013

(54) ALIGNMENT DEVICE FOR USE WITH A TAPPET

(75) Inventors: Anthony P. Copper, Greenville, SC (US); James Darren Tedder, Harriman, TN (US)

(73) Assignee: Koyo Bearings USA LLC, Westlake, OH (US)

( * ) Notice: Subject to any disclaimer, the term of this patent is extended or adjusted under 35 U.S.C. 154(b) by 297 days.

(21) Appl. No.: 12/990,452

(22) PCT Filed: Sep. 4, 2009

(86) PCT No.: PCT/US2009/055974

§ 371 (c)(1),
(2), (4) Date: Oct. 29, 2010

(87) PCT Pub. No.: WO2010/028204

PCT Pub. Date: Mar. 11, 2010

(65) Prior Publication Data

US 2011/0259142 A1 Oct. 27, 2011

Related U.S. Application Data

(60) Provisional application No. 61/094,225, filed on Sep. 4, 2008.

(51) Int. Cl.
*F01L 1/14* (2006.01)

(52) U.S. Cl.
USPC ..... 123/90.5; 123/90.48; 74/569

(58) Field of Classification Search
USPC ..... 123/90.15, 90.16, 90.48–90.59; 74/569; 29/888.43
See application file for complete search history.

(56) References Cited

U.S. PATENT DOCUMENTS

| | | | | |
|---|---|---|---|---|
| 4,747,376 | A * | 5/1988 | Speil et al. | 123/90.55 |
| 7,210,437 | B2 | 5/2007 | Geyer | |
| 2006/0016406 | A1 | 1/2006 | Geyer | |
| 2006/0107917 | A1 * | 5/2006 | Backert et al. | 123/90.48 |

FOREIGN PATENT DOCUMENTS

| | | | |
|---|---|---|---|
| DE | 4324756 | A1 | 2/1995 |
| DE | 10332981 | A1 | 2/2005 |
| EP | 1659268 | A1 | 5/2006 |
| JP | 02118103 | U | 9/1990 |
| JP | 2000136711 | A | 5/2000 |
| JP | 2006528296 | | 12/2006 |

OTHER PUBLICATIONS

PCT International Search Report and Written Opinion, dated Dec. 16, 2009.
Office Action dated Jun. 28, 2012 for co-pending Korean Patent Application No. 10-2011-7002687.
Office Action dated Jun. 22, 2012 for co-pending Japanese Patent Application No. 2011-518963.

(Continued)

*Primary Examiner* — Thomas Denion
*Assistant Examiner* — Daniel Bernstein
(74) *Attorney, Agent, or Firm* — Nelson Mullins Riley & Scarborough, LLP

(57) ABSTRACT

A tappet (10) is movable along an axis. The tappet (10) includes a skirt defining an opening (18) and an alignment device (22) positioned at least partially within the opening (18). The alignment device (22) has a generally T-shaped cross-sectional shape when taken through a plane substantially parallel to the axis and has a non-T-shaped cross-sectional shape when taken through a plane substantially perpendicular to the axis.

20 Claims, 4 Drawing Sheets

(56) References Cited

OTHER PUBLICATIONS

Second Office Action dated May 22, 2013 for corresponding Chinese Patent Application No. 200980130128.7.

Office Action dated Oct. 10, 2012 for co-pending Chinese Patent Application No. 200980130128.7.

Notice of Fnal Rejection dated Jan. 13, 2013 for co-pending Korean Patent Application No. 10-2011-7002687.

* cited by examiner

ALIGNMENT DEVICE FOR USE WITH A TAPPET

RELATED APPLICATIONS

This applications claims priority to U.S. Provisional Patent Application No. 61/094,225, filed Sep. 4, 2008, the entire content of which is hereby incorporated by reference herein.

BACKGROUND

The present invention relates to tappets and, more particularly, to alignment devices for use with tappets.

Tappets are typically included in a valve train of an internal combustion engine to transmit motion from a cam shaft of the engine to one or more intake or exhaust valves. As the cam shaft rotates, the tappets receive both a sideways force and a downward force from the cam shaft, but only transmit the downward force to the valves to open and/or close the valves. The tappets thereby reduce the possibility of bending or otherwise damaging the valves during operation of the engine.

SUMMARY

In one embodiment, the invention provides a tappet movable along an axis. The tappet includes a skirt defining an opening and an alignment device positioned at least partially within the opening. The alignment device has a generally T-shaped cross-sectional shape when taken through a plane substantially parallel to the axis and has a non-T-shaped cross-sectional shape when taken through a plane substantially perpendicular to the axis.

In another embodiment, the invention provides a tappet movable along an axis. The tappet includes a skirt defining a generally cylindrical outer surface, an opening, and a flat formed in the outer surface adjacent the opening. The tappet further includes an alignment device positioned at least partially within the opening. The alignment device includes a stem portion, a head portion, and a lip formed between the stem portion and the head portion. The lip is engaged with the flat to provide a flat surface to flat surface engagement, thereby increasing an area of contact between the skirt and the alignment device.

Other aspects of the invention will become apparent by consideration of the detailed description and accompanying drawings.

DETAILED DESCRIPTION

Figure 1:
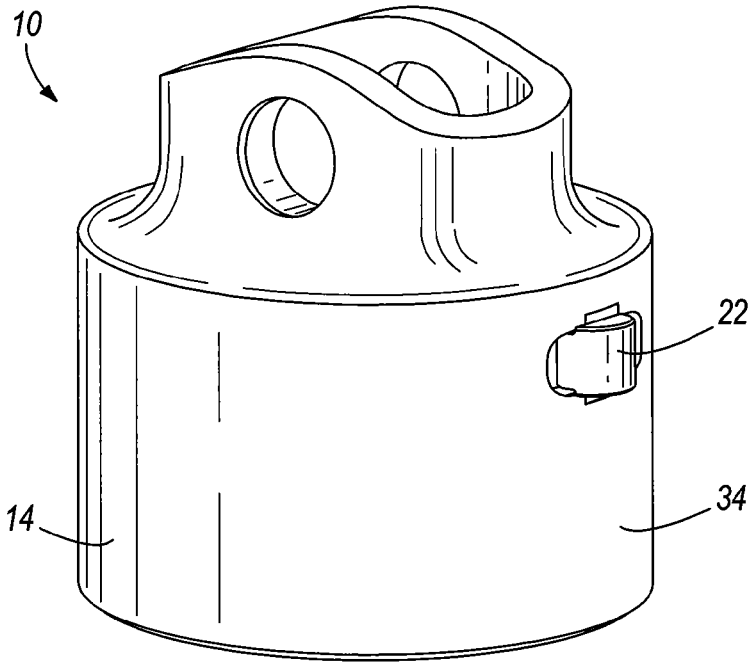
FIG. 1 is a perspective view of a tappet including an alignment device according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. In addition, the terms "top," "bottom," "rear," "front," "vertical," "horizontal," etc. are used to facilitate description with respect to the orientations shown in the drawings and are not intended to be limiting.

Figure 2:
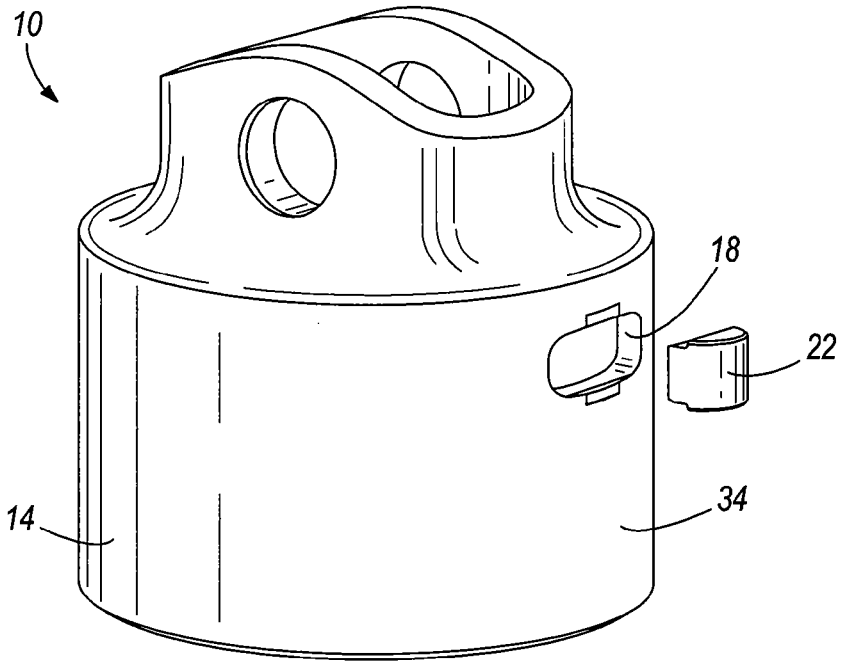
FIG. 2 is an exploded perspective view of the tappet and the alignment device shown in FIG. 1.

FIGS. 1 and 2 illustrate a tappet 10 embodying the invention. The tappet 10 is configured for use in a valve train of an internal combustion engine to facilitate opening and closing an intake valve or an exhaust valve of the valve train. As a cam shaft of the engine rotates, a portion of the cam shaft, or a rocker arm connected to the cam shaft, engages the tappet 10 to convert the rotational motion of the cam shaft into linear motion of the tappet 10. A valve head of the intake or exhaust valve is positioned within and connected to the tappet 10 such that, as the tappet 10 moves in a linear direction, the valve is opened and closed. Forces from the cam shaft are thereby transmitted through the tappet 10 to the valve such that only forces in substantially the same direction as the motion of the valve act on the valve. In addition, the tappet 10 serves as a torsional vibration isolation device between the cam shaft and the valve to inhibit rotational forces from being transmitted to the valve. Although the tappet 10 is specifically described for use in an internal combustion engine, the tappet 10 may additionally or alternatively be used in other types of assemblies where it is desirable to translate rotational motion of one component into linear motion of another component. For example, the tappet 10 may be configured for use in a fluid pump to help drive a fluid (e.g., fuel, oil, water, or the like).

The illustrated tappet 10 is a cup-shaped tappet and includes a skirt 14. The skirt 14 is generally cylindrical and defines an opening 18 for receiving an alignment device 22. In the illustrated embodiment, the opening 18 is generally rectangular and is formed by, for example, piercing, machining, or otherwise cutting into the skirt 14. The opening 18 is also generally larger (e.g., wider) than the alignment device 22 to provide clearance for the alignment device 22 during assembly of the alignment device 22 and the tappet 10. In addition, providing a generally larger opening 18 increases tolerances while locating and machining the opening 18 in the skirt 14. In other embodiments, the opening 18 may be another suitable shape for receiving a similarly shaped alignment device and/or the opening 18 may be relatively larger or smaller.

Figure 3:
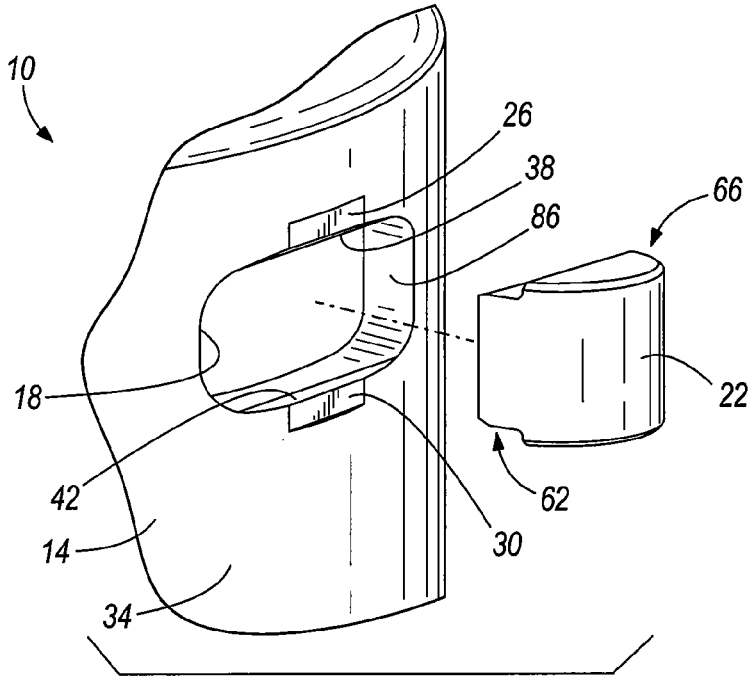
FIG. 3 is an enlarged exploded perspective view of a portion of the tappet and the alignment device shown in FIG. 1.

As shown in FIG. 3, the skirt 14 also defines two flats 26, 30, or indentations, formed on an outer surface 34 of the skirt 14 adjacent to the opening 18. In the illustrated embodiment, the flats 26, 30 are positioned on opposite sides of the opening 18 (e.g., above and below on leading and trailing sides relative to the direction of reciprocation of the tappet 10). The flats 26, 30 are configured to receive portions of the alignment device 22 extending beyond a perimeter of the opening 18 to help position and secure the alignment device 22 within the opening 18. The flats 26, 30 also help control axis-to-axis position between the tappet 10 and the alignment device 22 such that a longitudinal axis of the alignment device 22 is generally parallel to and properly spaced from a longitudinal axis of the tappet 10. The illustrated flats 26, 30 have widths that are less than the width of the opening 18, but are generally the same width as the alignment device 22. A beveled edge 38, 42 is formed between each flat 26, 30 and the opening 18 to facilitate assembly (e.g., insertion) of the alignment device 22 into the opening 18.

Figure 4:
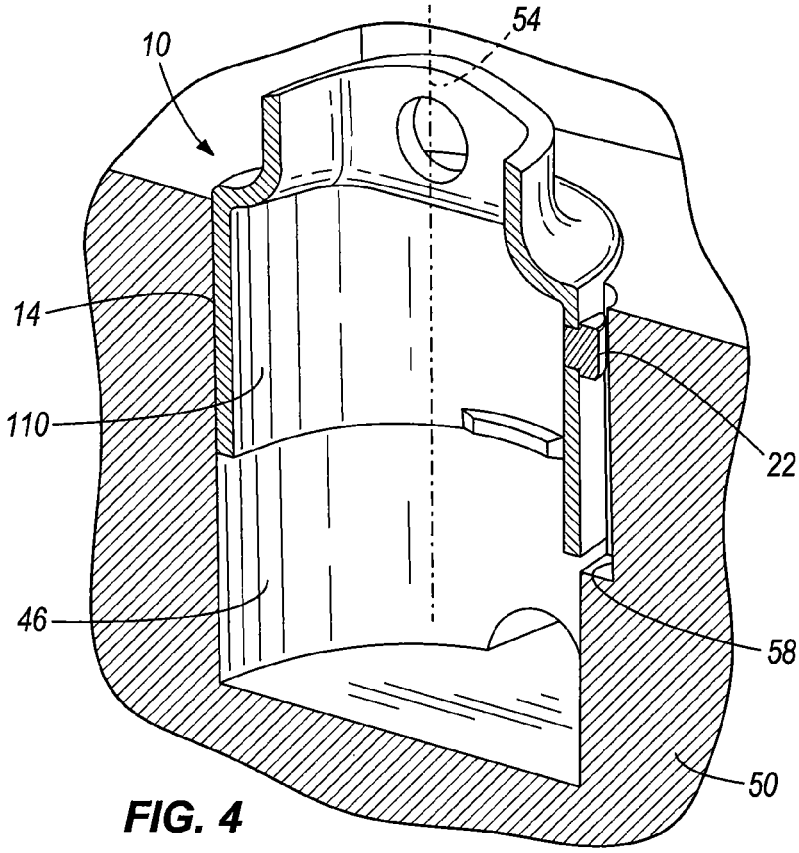
FIG. 4 is a cross-sectional view of the tappet positioned within a guide bore of an internal combustion engine.

As shown in FIG. 4, the tappet 10 is positioned within a guide bore 46 in, for example, a cylinder head 50 of an internal combustion engine. The tappet 10 moves (e.g., oscillates or reciprocates) within the guide bore 46 along a central axis 54 to transmit motion from a cam shaft of the internal combustion engine to a valve (e.g., an intake valve or an exhaust valve). The illustrated guide bore 46 defines a groove 58 extending along a portion of the length of the guide bore 46. The groove 58 receives a portion of the alignment device 22 to ensure proper alignment of the tappet 10 within the bore 46 during manufacture and assembly of the engine. The groove 58 and the alignment device 22 also cooperate to prevent rotation of the tappet 10 about the central axis 54 during operation of the internal combustion engine.

Figure 5:
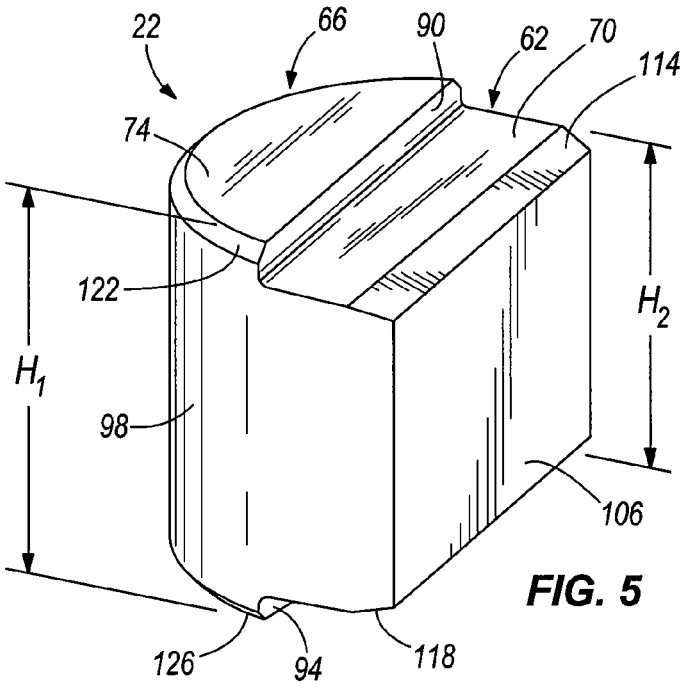
FIG. 5 is an enlarged perspective view of the alignment device shown in FIG. 1.
Figure 6:
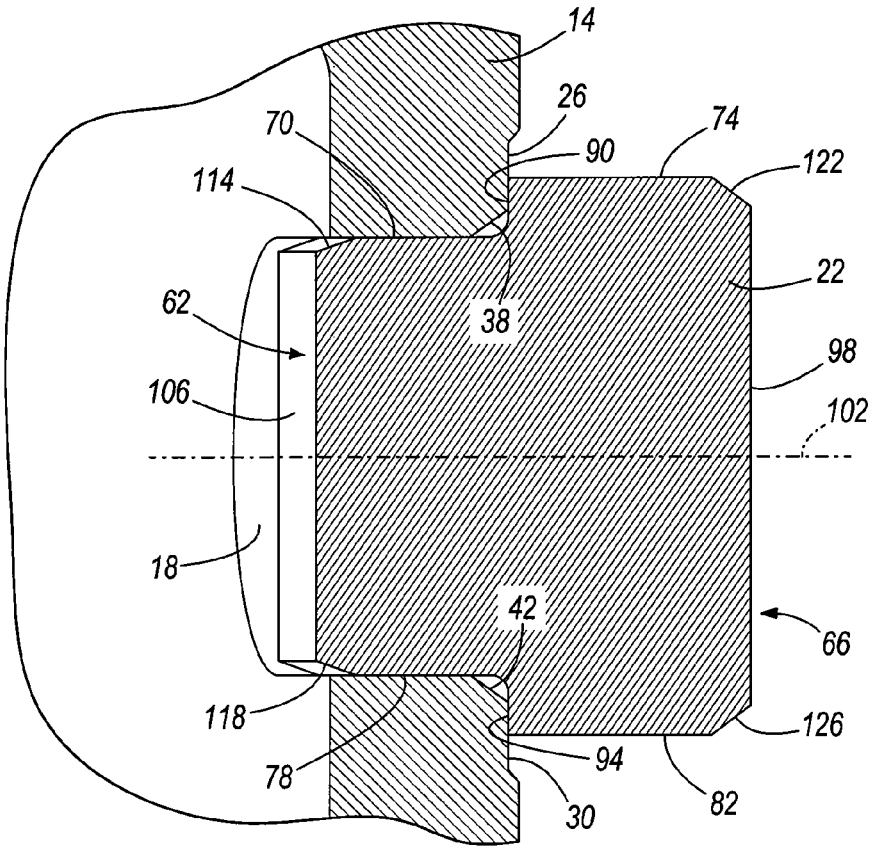
FIG. 6 is an enlarged cross-sectional view of the alignment device shown in FIG. 5 coupled to the tappet.

FIG. 5 illustrates the alignment device 22 in more detail. The illustrated alignment device 22, or dowel pin, includes a stem portion 62 and a head portion 66 integrally formed as a single piece. In other embodiments, the stem portion 62 and the head portion 66 may be separate pieces welded, glued, or otherwise fastened together. Each portion 62, 66 includes a generally planar first, or top, surface 70, 74 and a generally planar second, or bottom, surface 78, 82 (FIG. 6). The stem portion 62 fits within the opening 18 in the skirt 14 to couple the dowel pin 22 to the skirt 14. As shown in FIG. 6, the height of the stem portion 62 is substantially the same as the height of the opening 18 such that the stem portion 62 is held in place by an interference fit between the top and bottom surfaces 70, 78 of the stem portion 62 and an inner perimeter surface 86 (FIG. 3) of the opening 18. In some embodiments, the stem portion 62 may additionally be secured within the opening 18 of the skirt 14 using suitable coupling means (e.g., fasteners, adhesives, or the like).

The head portion 66 extends outwardly from the skirt 14 and fits within the groove 58 formed in the guide bore 46 (FIG. 4). In the illustrated embodiment, a height $H_1$ of the head portion 66 of the dowel pin 22 (as measured in the direction of travel of the tappet 10) is greater than a height $H_2$ of the stem portion 62 (as measured in the same direction as height $H_1$), forming an upper lip 90 between the top surfaces 70, 74 of the stem and head portions 62, 66 and a lower lip 94 between the bottom surfaces 78, 82 of the stem and head portions 62, 66. Each lip 90, 94 fits within one of the flats 26, 30 adjacent to the opening 18 to help position and secure the dowel pin 22 within the opening 18. The flats 26, 30 and the lips 90, 94 also provide a flat surface to flat surface engagement, increasing the area of contact between the skirt 14 and the dowel pin 22. In some embodiments, the difference between the height $H_1$ of the head portion 66 and the height $H_2$ of the stem portion 62 is between about 0.5 mm and about 6.0 mm such that each lip 90, 94 is between about 0.25 mm and about 3.0 mm tall. In the illustrated embodiment, the height $H_1$ of the head portion 66 is about 5.0 mm and the height $H_2$ of the stem portion 62 is about 4.0 mm such that the height difference is about 1.0 mm and each lip 90, 94 is about 0.5 mm tall.

Since the head portion 66 is taller than the stem portion 62, the dowel pin 22 has a generally T-shaped cross-sectional shape when viewed on its side (see FIGS. 4 and 6) and taken through a plane substantially parallel to, or including, the central axis 54. The plane thereby extends in substantially the same direction as the direction of motion of the tappet 10. In the illustrated embodiment, the central axis 54 extends in the vertical direction such that the plane is a substantially vertical plane. Such an orientation is for illustrative purposes only. In other embodiments, the tappet 10 may reciprocate at an angle (e.g., between about 1° and 179°) relative to vertical. The plane may also be angled relative to vertical so that the plane extends in substantially the same direction as the direction of motion of the tappet 10.

Referring back to FIG. 5, the stem portion 62 and the head portion 66 have generally the same width such that the dowel pin 22 includes a curved side surface 98. In the illustrated embodiment, the dowel pin 22 has a partially circular cross-sectional shape when taken through a plane 102 (FIG. 6) substantially perpendicular to the central axis 54 (e.g., when viewed from the top or bottom). In the illustrated embodiment, the plane 102 is a substantially horizontal plane, but may alternatively be angled relative to horizontal in embodiments where the tappet 10 reciprocates at an angle relative to vertical.

The stem portion 62 includes a planar rear surface 106 such that the cross-sectional shape of the dowel pin 22 when taken through plane 102 is only a partial circle. The planar rear surface 106 minimizes the amount that the stem portion 62 extends into the tappet 10, providing clearance within a cavity 110 (FIG. 4) of the skirt 14 for other components (e.g., a valve spring, a pump plunger, or a head of the intake or exhaust valve). In other embodiments, the dowel pin 22 may have other suitable cross-sectional shapes when taken through the plane 102. For example, the dowel pin 22 may have a fully circular (see FIG. 7), a rectangular, a square, or a hexagonal cross-sectional shape. Providing a constant width throughout the dowel pin 22, and particularly at the interface between the stem portion 62 and the head portion 66, increases the overall strength of the dowel pin 22 by eliminating any stepped configurations or stress concentrations, reducing the possibility of shearing the dowel pin 22 when the tappet 10 tries to rotate within the guide bore 46 (FIG. 4) about the central axis 54.

The stem portion 62 includes an upper beveled edge 114 between the top surface 70 of the stem portion 62 and the rear surface 106. The stem portion 62 also includes a lower beveled edge 118 between the bottom surface 78 of the stem portion 62 and the rear surface 106. The beveled edges 114, 118 of the stem portion 62 facilitate insertion of the stem portion 62 into the opening 18 in the skirt 14 during assembly of the tappet 10.

Similar to the stem portion 62, the head portion 66 includes an upper beveled edge 122 between the top surface 74 of the head portion 66 and the curved side surface 98. The head portion 66 also includes a lower beveled edge 126 between the bottom surface 82 of the head portion 66 and the curved side surface 98. The beveled edges 122, 126 of the head portion 66 create a smoother transition between the top and bottom surfaces 74, 82 and the curved side surface 98, reducing the possibility of the dowel pin 22 catching or snagging on an imperfection (e.g., a protrusion) present on a surface of the guide bore 46 while the dowel pin 22 reciprocates within the guide bore 46.

Figure 7:
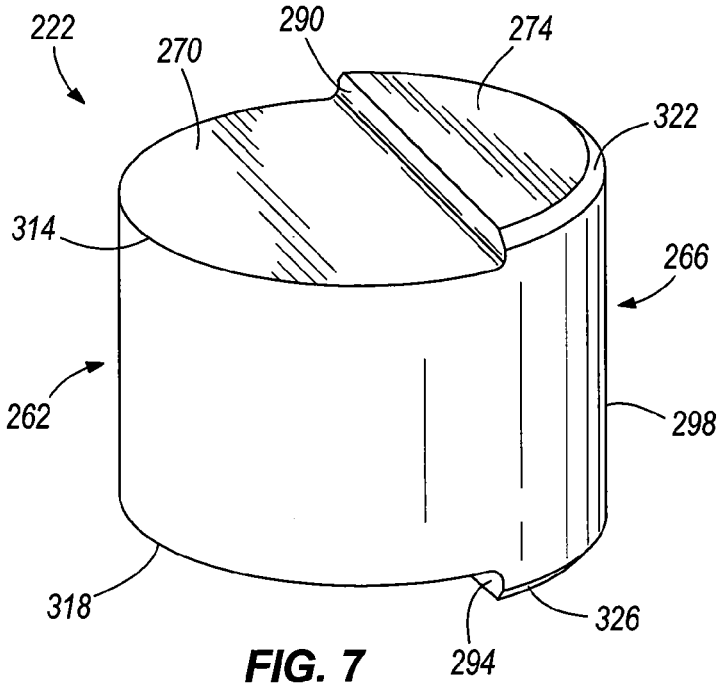
FIG. 7 is an enlarged perspective view of an alignment device according to another embodiment of the invention.

FIG. 7 illustrates another example of an alignment device 222 for use with the tappet 10. Similar to the alignment device 22 discussed above with reference to FIGS. 5 and 6, the illustrated alignment device 222, or dowel pin, includes a stem portion 262 and a head portion 266 integrally formed as a single piece. Each portion 262, 266 includes a generally planar top surface 270, 274 and a generally planar bottom surface. The stem portion 262 fits within the opening 18 in the skirt 14 to couple the dowel pin 222 to the skirt 14. The height of the stem portion 262 is substantially the same as the height of the opening 18 such that the stem portion 262 is held in place by an interference fit, but may additionally or alternatively be secured within the opening 18 using other suitable coupling means.

The head portion 266 extends outwardly from the skirt 14 and fits within the groove 58 formed in the guide bore 46 (FIG. 4). In the illustrated embodiment, the height of the head portion 266 of the dowel pin 222 is greater than the height of the stem portion 262, forming an upper lip 290 between the top surfaces 270, 274 of the stem and head portions 262, 366 and a lower lip 294 between the bottom surfaces of the stem and head portions 262, 266. Each lip 290, 294 fits within one of the flats 26, 30 (FIG. 3) adjacent to the opening 18 to help position and secure the dowel pin 222 in the opening 18.

Similar to the dowel pin 22 discussed above, the height difference between the stem portion 262 and the head portion 266 causes the dowel pin 222 to have a generally T-shaped cross-sectional shape when taken through a plane substantially parallel to, or including, the central axis 54 (FIG. 4). The widths of the stem portion 262 and the head portion 266 are equal such that the dowel pin 222 includes a continuous, curved side surface 298. In the illustrated embodiment, the dowel pin 222 has a completely circular cross-sectional shape when taken through the plane 102 (FIG. 6) substantially perpendicular to the central axis 54. Such a construction is feasible when space within the cavity 46 of the skirt 14 allows the dowel pin 222 to protrude deeper into the cavity 110.

The illustrated head portion 266 includes an upper beveled edge 322 between the top surface 274 of the head portion 266 and the curved side surface 298. The head portion 266 also includes a lower beveled edge 326 between the bottom surface of the head portion 266 and the curved side surface 298. In the illustrated embodiment, the stem portion 262 includes non-beveled edges 314, 318 between the top and bottom surfaces 270 and the curved side surface 298 of the stem portion 262. In other embodiments, the stem portion 262 may include upper and lower beveled edges, similar to the dowel pin 22 discussed above.

Figure 8:
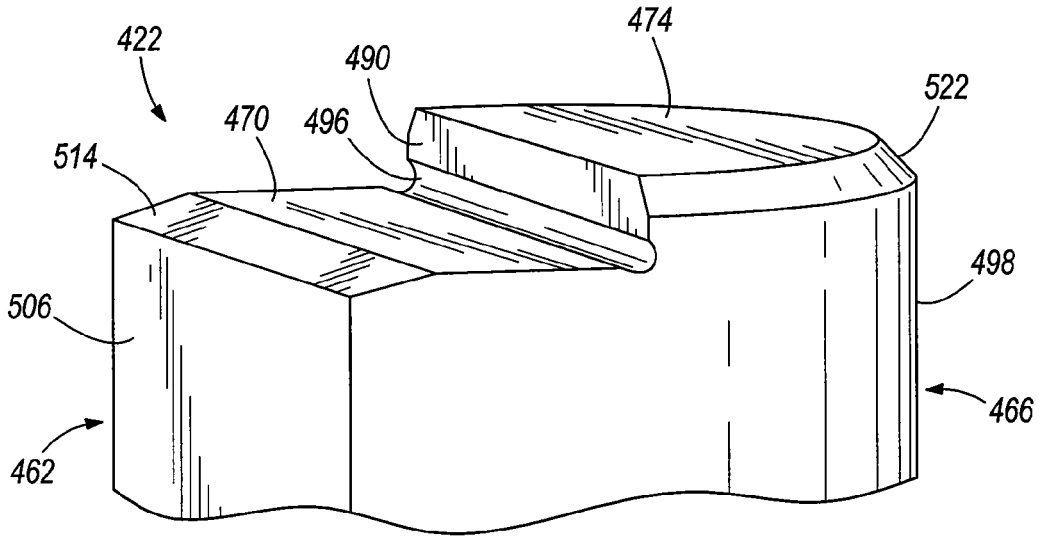
FIG. 8 is an enlarged perspective view of a portion of an alignment device according to yet another embodiment of the invention.

FIG. 8 illustrates a portion of another example of an alignment device 422 for use with the tappet 10. Similar to the alignment devices 22, 222 discussed above with reference to FIGS. 5-7, the illustrated alignment device 422, or dowel pin, includes a stem portion 462 and a head portion 466 integrally formed as a single piece. Each portion 462, 466 includes a generally planar top surface 470, 474 and a generally planar bottom surface (not shown). The stem portion 462 fits within the opening 18 in the skirt 14 to couple the dowel pin 422 to the skirt 14. The height of the stem portion 462 is substantially the same as the height of the opening 18 such that the stem portion 462 is held in place by an interference fit, but may additionally or alternatively be secured within the opening 18 using other suitable coupling means.

The head portion 466 extends outwardly from the skirt 14 and fits within the groove 58 formed in the guide bore 46 (FIG. 4). In the illustrated embodiment, the height of the head portion 466 of the dowel pin 422 is greater than the height of the stem portion 462, forming an upper lip 490 between the top surfaces 470, 474 of the stem and head portions 462, 466 and a lower lip (not shown) between the bottom surfaces of the stem and head portions 462, 466. Each lip 490 fits within one of the flats 26, 30 (FIG. 3) adjacent to the opening 18 to help position and secure the dowel pin 422 in the opening 18. The illustrated dowel pin 422 also includes an undercut 496 formed adjacent to the upper lip 490. The undercut 496 provides additional clearance for the skirt 14 when the stem portion 462 is inserted into the opening 18. Although not shown, the dowel pin 422 may also include a second undercut formed adjacent to the bottom lip between the stem portion 462 and the head portion 466 in a manner similar to the illustrated undercut 496.

Similar to the dowel pins 22, 222 discussed above, the height difference between the stem portion 462 and the head portion 466 causes the dowel pin 422 to have a generally T-shaped cross-sectional shape when taken through the plane substantially parallel to, or including, the central axis 54 (FIG. 4). The widths of the stem portion 462 and the head portion 466 are equal such that the dowel pin 422 includes a curved side surface 498. In the illustrated embodiment, the stem portion 462 includes a planar rear surface 506 such that the dowel pin 422 has a partial circular cross-sectional shape when taken through the plane 102 (FIG. 6) substantially perpendicular to the central axis 54, similar to the dowel pin 22 shown in FIGS. 5 and 6.

The stem portion 462 includes an upper beveled edge 514 between the top surface 470 of the stem portion 462 and the rear surface 506. The head portion 466 also includes an upper beveled edge 522 between the top surface 474 of the head portion 466 and the curved side surface 498. Although not shown, the stem portion 462 and the head portion 466 may each include a lower beveled edge between the bottom surfaces and the rear surface 506 or the side surface 498, respectively.

Although the invention has been described in detail with reference to certain preferred embodiments, variations and modifications exist within the scope and spirit of one or more independent aspects of the invention as described.

The invention claimed is:

1. A tappet movable along an axis, the tappet comprising:

a skirt defining an opening;

an alignment device positioned at least partially within the opening, the alignment device having a head portion, a stem portion and a generally T-shaped cross-sectional shape when taken through a plane substantially parallel to the axis and having a non-T-shaped cross-sectional shape when taken through a plane substantially perpendicular to the axis; and wherein the width of the stem portion is the same as the width of the head portion at an interface between the stem portion and the head portion when viewed in a cross-section taken through a plane perpendicular to the axis.

2. The tappet of claim 1, wherein the non-T-shaped cross-sectional shape is a partially circular cross-sectional shape.

3. The tappet of claim 2, wherein the alignment device includes a curved surface and a planar surface to define the partially circular cross-sectional shape.

4. The tappet of claim 1, wherein the non-T-shaped cross-sectional shape is a fully circular cross-sectional shape.

5. The tappet of claim 1, wherein the stem portion has a first height and the head portion has a second height, and wherein the second height is greater than the first height.

6. The tappet of claim 5, wherein a difference between the first height and the second height is between about 0.5 mm and about 6.0 mm.

7. The tappet of claim 5, wherein the first height is about 4.0 mm and the second height is about 5.0 mm.

8. The tappet of claim 5, wherein the stem portion is positioned substantially within the opening and the head portion extends outwardly from the skirt.

9. The tappet of claim 5, wherein the alignment device includes a lip formed between a first generally planar surface of the stem portion and a first generally planar surface of the head portion.

10. The tappet of claim 9, wherein the skirt includes a flat adjacent to the opening, and wherein the lip of the alignment device engages the flat.

11. The tappet of claim 10, wherein the alignment device includes a second lip formed between a second generally planar surface of the stem portion and a second generally planar surface of the head portion, wherein the skirt includes a second flat adjacent to the opening, and wherein the second lip of the alignment device engages the second flat.

12. The tappet of claim 9, wherein the alignment device includes an undercut formed adjacent to the lip.

13. The tappet of claim 5, wherein the stem portion includes at least one beveled edge, and wherein the at least one beveled edge facilitates insertion of the stem portion into the opening.

14. The tappet of claim 5, wherein the head portion includes at least one beveled edge, and wherein the at least one beveled edge reduces the possibility of the alignment device snagging as the tappet moves along the axis.

15. The tappet of claim 1, wherein the skirt includes at least one beveled edge adjacent to the opening, and wherein the at least one beveled edge facilitates insertion of a portion of the alignment device into the opening.

16. A tappet movable along an axis, the tappet comprising:

a skirt defining a generally cylindrical outer surface, an opening, and a flat formed in the outer surface adjacent the opening; and an alignment device positioned at least partially within the opening, the alignment device including a stem portion, and a head portion;

wherein the width of the stem portion is the same as the width of the head portion at an interface between the stem portion and the head portion when viewed in a cross-section taken through a plane perpendicular to the axis.

17. The tappet of claim 16, further comprising a lip formed between the head portion and the stem portion, wherein the lip is engaged with the flat to provide a flat surface to flat surface engagement, thereby increasing an area of contact between the skirt and the alignment device.

18. The tappet of claim 17, wherein the flat is formed adjacent a side of the opening that defines a leading and trailing side of the opening as the tappet moves along the axis.

19. The tappet of claim 17, wherein the flat is a first flat, wherein the skirt defines a second flat formed in the outer surface adjacent an opposite side of the opening from the first flat, and wherein the alignment device includes a second lip formed between the stem portion and the head portion and engaged with the second flat.

20. The tappet of claim 17, wherein the alignment device has a generally T-shaped cross-sectional shape when taken through a plane substantially parallel to the axis and has a non-T-shaped cross-sectional shape when taken through a plane substantially perpendicular to the axis.

* * * * *